United States Patent [19]

Ray

[11] Patent Number: 4,460,864

[45] Date of Patent: Jul. 17, 1984

[54] VOLTAGE REFERENCE CIRCUIT

[75] Inventor: Kenneth I. Ray, Mesa, Ariz.

[73] Assignee: Motorola, Inc., Schaumburg, Ill.

[21] Appl. No.: 476,172

[22] Filed: Mar. 17, 1983

[51] Int. Cl.[3] ..... G05F 3/20

[52] U.S. Cl. ..... 323/313; 307/297

[58] Field of Search ..... 323/313, 314, 315, 316, 323/907; 307/296 R, 297

[56] References Cited

U.S. PATENT DOCUMENTS

| | | | |
|---|---|---|---|
| 3,846,696 | 11/1974 | Ahmed | 323/313 X |
| 3,956,661 | 5/1976 | Sakamoto et al. | 323/313 X |
| 4,030,023 | 6/1977 | Keith | 323/313 |
| 4,063,147 | 12/1977 | Hatanaka et al. | 323/313 |

FOREIGN PATENT DOCUMENTS

| | | | |
|---|---|---|---|
| 57-132214 | 8/1982 | Japan | 323/313 |

*Primary Examiner*—Peter S. Wong

*Attorney, Agent, or Firm*—Michael D. Bingham

[57] ABSTRACT

A voltage reference circuit for producing a predetermined output voltage at an output thereof having good output voltage regulation and which includes a diode bias string and a transistor having its base-emitter path coupled via a diode between predetermined ones of the diodes comprising the diode bias string. The output of the voltage reference circuit is taken at the emitter of the transistor. The voltage reference circuit presents a low impedance at the output thereof and is capable of both sourcing and sinking current thereat over a wide range of current values.

5 Claims, 3 Drawing Figures

– PRIOR ART –

– PRIOR ART –

VOLTAGE REFERENCE CIRCUIT

BACKGROUND OF THE INVENTION

The present invention relates to voltage reference circuits and, more particularly, to a diode voltage reference circuit for providing a stable reference voltage with a low impedance output at which current may be both sourced and sunk.

Diode voltage references, which are suited for manufacture in monolithic integrated circuit form, are well known to those in the art. A common type of diode voltage reference circuit is shown in FIG. 1 herein. Although the voltage reference circuit illustrated in FIG. 1 provides a predetermined voltage at the output thereof its performance degrades significantly as current is sourced from the output. Additionally, this voltage reference circuit is not capable of sourcing currents over a wide range of values.

Another known diode voltage reference circuit is illustrated in FIG. 2 and will be discussed in more detail later. However, the performance of this type of voltage reference circuit degrades significantly when current is sunk at the output.

Thus, there is a need for a diode voltage reference circuit which is relatively simple in structure and which can provide a low impedance to both sinking and sourcing currents at an output thereof while producing a stable output voltage over a wide range of current values.

SUMMARY OF THE INVENTION

Accordingly, it is an object of the present invention to provide an improved voltage reference circuit.

It is another object of the invention to provide an improved monolithic integrated voltage reference circuit.

A further object of the present invention is to provide an improved diode voltage reference circuit for establishing a stable voltage at a low impedance output which can both sink and source current over a wide range of current values.

In accordance with the above and other objects there is provided a voltage reference circuit for producing a predetermined voltage at an output thereof comprising first and second power supply conductors; diode bias means coupled between the first and second power supply conductors including a plurality of diodes in series connection; a transistor having first and second control electrodes wherein the first electrode is coupled to an output of the voltage reference circuit and the second electrode is coupled to the first conductor with the control electrode being coupled at a first circuit node to the diode bias means; and diode means coupled between the first electrode of the transistor and a second circuit node to the diode bias means.

DETAILED DESCRIPTION OF THE PREFERRED EMBODIMENT

Figure 1:
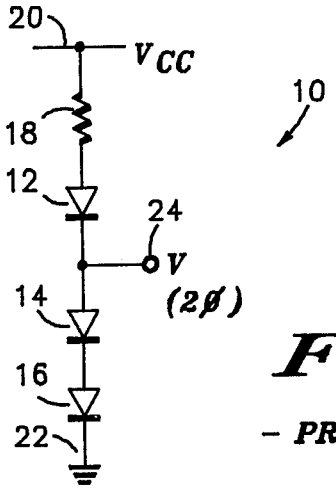
FIG. 1 is a schematic diagram illustrating a prior art diode voltage reference circuit.

Turning to FIG. 1 there is shown a known diode voltage reference circuit that has found use in the art. Voltage reference circuit 10 includes a diode bias reference means comprised of diodes 12, 14, 16 and resistor 18 which are all series connected between first and second power supply conductors 20 and 22 at which are supplied an operating bias potential and a common reference potential respectively. The output of voltage reference circuit 10 is taken at output node 24 which is coupled to the anode of diode 14.

As long as sufficient quiescent bias current flows through the diodes, a reference voltage, $V_{OUT}$, equal to approximately $2\phi$ (where $\phi$ is the voltage drop across a standard diode) is supplied at output 24. Circuit 10 is suited mainly for sinking current at output 24. However, the reference voltage $V_{OUT}$ will degrade significantly as current is pulled from the output unless the output current is maintained at a value very much less than the quiescent current flowing through the diode string.

Thus, to be able to source a wide range of current values at the output of the above described voltage reference circuit, the quiescent current must be very large. Hence, the efficiency of this circuit is very poor. Additionally, if the prior art voltage reference circuit is utilized in a monolithic integrated circuit, the excessive quiescent current can produce undesirable power dissipation in the integrated circuit.

Figure 2:
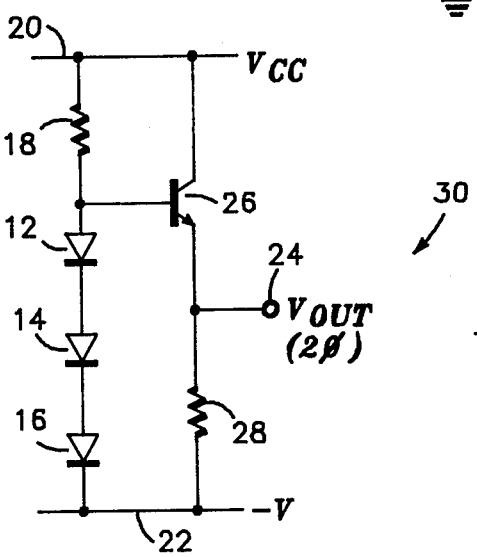
FIG. 2 is a schematic diagram illustrating another prior art diode voltage reference circuit.

Referring to FIG. 2 there is shown voltage reference circuit 30 which is generally known to those skilled in the art. It is to be understood that components of the remaining figures which correspond to like components in FIG. 1 are designated by the same reference numbers. As illustrated, transistor 26 has been added and has its control electrode or base connected to a circuit node of the diode string which in the present case is at the anode of diode 12. The collector-emitter path of transistor 26 is coupled between power supply conductor 20 and common reference supply 22 via resistor 28. The output 24 of reference circuit 30 is taken at the connection between the emitter of transistor 26 and the upper end of resistor 28.

As is understood, by matching the characteristics of transistor 26 with those of diodes 12, 14 and 16, the voltage level, $V_{OUT}$ is made equal to $2\phi$. Circuit 30 is an improved circuit over that illustrated in FIG. 1 as current can be both sourced and sunk at output 24. However, as current is forced into output 24 the performance of circuit 30 degrades significantly until such time that transistor 26 is turned off by having its base-emitter contact reverse biased by the potential developed across resistor 28. To increase the range over which circuit 30 can operate with current being sourced into output 24 an excessive amount of quiescent current must flow through transistor 26 and resistor 28. This quiescent current, as was the case above, is wasted in the circuit operation and produces undesirable power dissipation.

Figure 3:
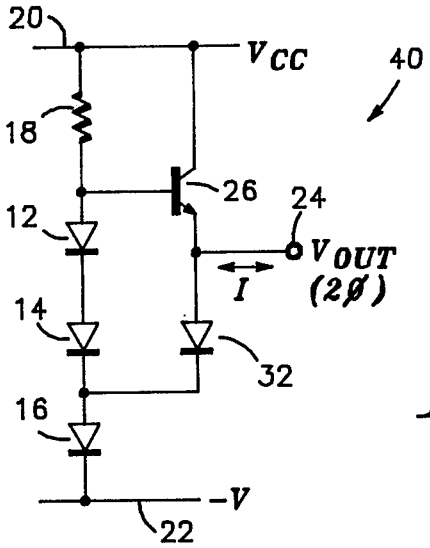
FIG. 3 is a schematic diagram illustrating a diode voltage reference circuit of the preferred embodiment of the present invention.

Attention is now drawn to FIG. 3 which illustrates voltage reference circuit 40 of the preferred embodiment. Voltage reference circuit 40 is suited to be manufactured in monolithic integrated circuit form and provides much improved performance with respect to the prior art voltage reference circuits described above. As shown, voltage reference circuit 40 includes the diode reference means comprising resistor 18 and diodes 12, 14 and 16 as already described. Transistor 26 has its control electrode connected to a first circuit node to the anode of transistor 12 and has its emitter coupled via diode 32 to a second circuit node to the anode of diode 16. Output 24 is taken at the emitter of transistor 26 as aforedescribed with reference to FIG. 2.

Diodes 12, 14 and 16 bias the base of transistor 26 at three diode voltage drops (3Ø) above the common reference potential supplied at conductor 22. The series connection of the base-emitter path of transistor 26 and diode 32 establishes a reference potential of 2Ø at the output 24. Voltage reference circuit 40 presents a low impedance to output 24 and provides good output voltage regulation over a wide range of current values with a minimal amount of required quiescent current. Unlike the voltage reference circuits of FIGS. 1 and 2, voltage reference circuit 40 is able to sink and source current at output 24 without significant degradation within said range of current values.

Although voltage reference circuit 40 of the preferred embodiment has been illustrated as providing an output regulated voltage of value 2Ø, it is understood that various predetermined output voltage levels could be established by using multiple diodes and/or Zeners. For example, by adding an additional diode in series connection between the cathode of diode 16 and common supply terminal 22, the value of the voltage $V_{OUT}$ is increased to 3Ø.

Thus, what has been described above, is an improved and novel voltage reference circuit wherein a stable regulated output voltage is produced at an output thereof over a wide range of current values that can be either sourced or sunk at the output of the circuit.

What is claimed is:

1. A voltage reference circuit for providing a predetermined voltage at an output thereof, comprising:

first and second power supply conductors;

diode bias means coupled between said first and second power supply conductors and including a plurality of diode means in series connection therebetween;

a transistor having first, second and control electrodes, said first electrode being coupled to the output of the voltage reference circuit, said second electrode being coupled to said first power supply conductor, said control electrode being coupled at a first circuit node to said diode bias means; and additional diode means coupled between said first electrode of said transistor and a second circuit node to said diode bias means.

2. The voltage reference circuit of claim 1 wherein said diode bias means includes:

first and second diodes series connected between said first and second circuit nodes; and a third diode connected between said second circuit node and said second power supply conductor.

3. The voltage reference circuit of claim 2 wherein:

said diode bias means includes a resistor coupled between said first power supply conductor and said first circuit node; and said additional diode means includes a fourth diode.

4. A monolithic integrated voltage reference circuit for providing a stable output voltage over a range of current values that are both sourced to and from an output thereof, comprising:

diode reference circuit means for establishing predetermined voltage potentials at first and second outputs thereof;

a transistor having first, second and control electrodes, said first electrode being coupled to an output of the voltage reference circuit, said second electrode being coupled to a first terminal at which is supplied an operating potential, said control electrode being coupled to said first output of said diode reference circuit means; and a diode coupled between said first electrode of said transistor and said second output of said diode reference circuit means.

5. The voltage reference circuit of claim 4 wherein said diode reference circuit means includes:

circuit means coupled between said first terminal at which is supplied an operating potential and said first output of said diode reference circuit means for providing a current to said first output;

at least two diodes in series connection between said first and second outputs of said diode reference circuit means; and an additional diode coupled between said second output of said diode reference circuit means and a second terminal at which is supplied a common reference potential.

* * * * *